US010073407B2

(12) United States Patent
Koyanagi

(10) Patent No.: US 10,073,407 B2
(45) Date of Patent: Sep. 11, 2018

(54) IMAGE FORMING APPARATUS

(71) Applicant: KYOCERA Document Solutions Inc., Osaka-shi, Osaka (JP)

(72) Inventor: Tsuyoshi Koyanagi, Osaka (JP)

( * ) Notice: Subject to any disclaimer, the term of this patent is extended or adjusted under 35 U.S.C. 154(b) by 0 days.

(21) Appl. No.: 15/842,630

(22) Filed: Dec. 14, 2017

(65) Prior Publication Data

US 2018/0173154 A1 Jun. 21, 2018

(30) Foreign Application Priority Data

Dec. 16, 2016 (JP) ..... 2016-244296

(51) Int. Cl.
*G03G 21/00* (2006.01)
*G03G 21/16* (2006.01)

(52) U.S. Cl.
CPC ..... *G03G 21/1638* (2013.01); *G03G 21/1623* (2013.01); *G03G 21/1633* (2013.01)

(58) Field of Classification Search
CPC ..... G03G 21/16; G03G 21/1623; G03G 21/1633; G03G 2221/1654; G03G 2221/1678; G03G 2221/169; B41J 13/00
See application file for complete search history.

(56) References Cited

U.S. PATENT DOCUMENTS 2,586,757 A * 2/1952 Wummel ..... E05D 11/06 16/250
7,343,118 B2 * 3/2008 Ahn ..... G03G 21/1633 292/DIG. 15
8,029,129 B2 * 10/2011 Hashimoto ..... B41J 29/13 292/DIG. 15
8,712,281 B2 * 4/2014 Nakano ..... G03G 15/0194 399/110
8,737,879 B2 * 5/2014 Ito ..... B41J 29/02 399/124
9,225,862 B2 * 12/2015 Liao ..... H04N 1/00551
9,229,420 B2 * 1/2016 Akiyama ..... G03G 21/1633
2008/0253802 A1 * 10/2008 Koyanagi ..... G03G 15/16 399/114
2013/0322916 A1 * 12/2013 Tamura ..... G03G 21/169 399/98

(Continued)

FOREIGN PATENT DOCUMENTS

JP 201421135 A 2/2014

*Primary Examiner* — David Bolduc
(74) *Attorney, Agent, or Firm* — Alleman Hall Creasman & Tuttle LLP

(57) ABSTRACT

An image forming apparatus includes a cover and a hinge portion. The hinge portion couples the cover with an apparatus main body in openable/closable manner. The hinge portion includes an inner rail member, an intermediate rail member, and a movable rail member. The inner rail member is provided on an inner side of an opening in the apparatus main body, and is arc-shaped. The intermediate rail member is slidably supported by the inner rail member and displaced between a first position and a second position. The movable rail member includes a coupling portion and a supported portion, is slidably supported by the intermediate rail member, and when the cover is opened, is slid from a third position to a fourth position which is further outward of the opening than the third position and at which the coupling portion is disposed below a lower edge of the opening.

9 Claims, 16 Drawing Sheets

(56) References Cited

U.S. PATENT DOCUMENTS

| | | | | |
|---|---|---|---|---|
| 2014/0003833 | A1* | 1/2014 | Asakawa | G03G 21/206 399/92 |
| 2014/0016962 | A1 | 1/2014 | Sato | |
| 2014/0137372 | A1* | 5/2014 | Yamashita | G03G 21/1647 16/221 |
| 2016/0047160 | A1* | 2/2016 | Huynh | E05F 15/77 49/31 |

* cited by examiner

IMAGE FORMING APPARATUS

This application is based upon and claims the benefit of priority from the corresponding Japanese Patent Application No. 2016-244296 filed on Dec. 16, 2016, the entire contents of which are incorporated herein by reference.

BACKGROUND

The present disclosure relates to an image forming apparatus including a cover closing an opening of an apparatus main body, and especially relates to a structure of a hinge portion coupling the cover with the apparatus main body in an openable and closable manner.

There is known an image forming apparatus such as a copier or a printer configured to form an image on a print sheet based on an electrophotographic system. In this type of image forming apparatus, an opening is provided so that a component can be attached to and detached from an inside of the apparatus, and a jammed print sheet can be taken out from the inside. The opening is usually closed by a cover, but needs to be opened as necessary. For this reason, the cover is povotably coupled with the apparatus main body by a hinge portion so that the opening can be opened and closed.

SUMMARY

An image forming apparatus according to an aspect of the present disclosure includes a cover and a hinge portion. The cover closes an opening formed in an apparatus main body. The hinge portion couples the cover with the apparatus main body in an openable and closable manner. The hinge portion includes an inner rail member, an intermediate rail member, and a movable rail member. The inner rail member is provided on an inner side of the opening in the apparatus main body, and is formed in a shape of an arc. The intermediate rail member is slidably supported by the inner rail member and displaced between a first position and a second position so as to draw an arc along the inner rail member, the first position being on the inner side of the opening, the second position being on an outer side of the opening, the intermediate rail member being formed in a shape of an arc. The movable rail member includes a coupling portion and an arc-shaped supported portion. The coupling portion is coupled with the cover. The supported portion is slidably supported by the intermediate rail member, and is formed in a shape of an arc. The movable rail member is displaced between a third position and a fourth position which is more on the outer side of the opening than the third position. At the third position, the coupling portion is disposed on an intermediate rail member side. At the fourth position, the coupling portion is disposed below a lower edge of the opening.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclusure with reference to the accompanying drawings. It should be noted that the following embodiment is an example of a specific embodiment of the present disclosure and should not limit the technical scope of the present disclosure.

Figure 1:
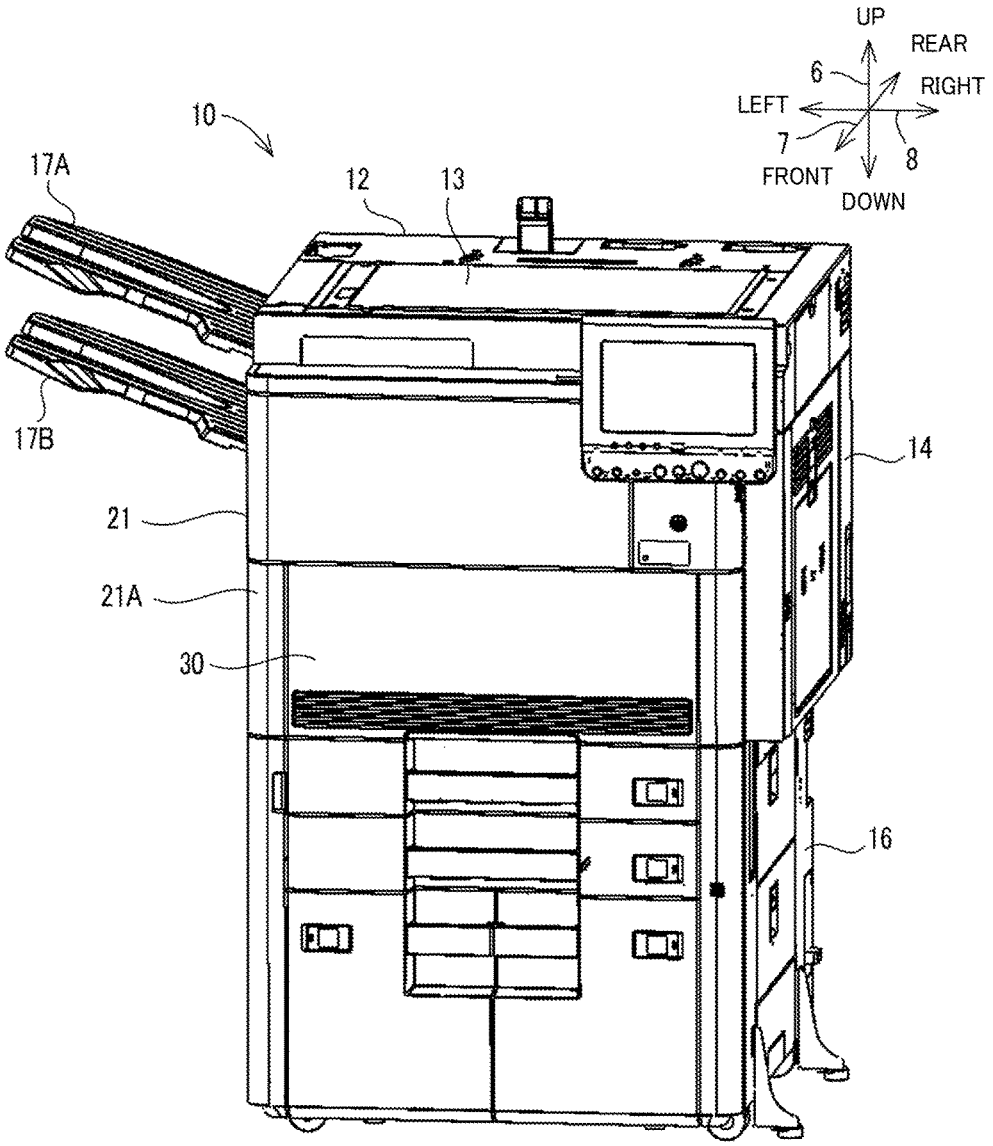
FIG. 1 is a perspective diagram showing an image forming apparatus according to an embodiment of the present disclosure.

FIG. 1 is a diagram showing a configuration of an image forming apparatus 10 according to the embodiment of the present disclosure. It is noted that for the sake of explanation, an up-down direction 6 and a front-rear direction are defined based on an installment state where the image forming apparatus 10 is installed in a usable manner (the state shown in FIG. 1). Furthermore, a left-right direction 8 is defined based on the front side of the image forming apparatus 10 in the installment state.

As shown in FIG. 1, the image forming apparatus 10 is a so-called multifunction peripheral, and has a plurality of functions such as a print function, a copy function, a facsimile function, and a scan function. It is noted that the image forming apparatus 10 is not limited to a multifunction peripheral, but may be any apparatus having the print function, for example, a dedicated apparatus such as a printer, a copier, or a facsimile apparatus.

Figure 2:
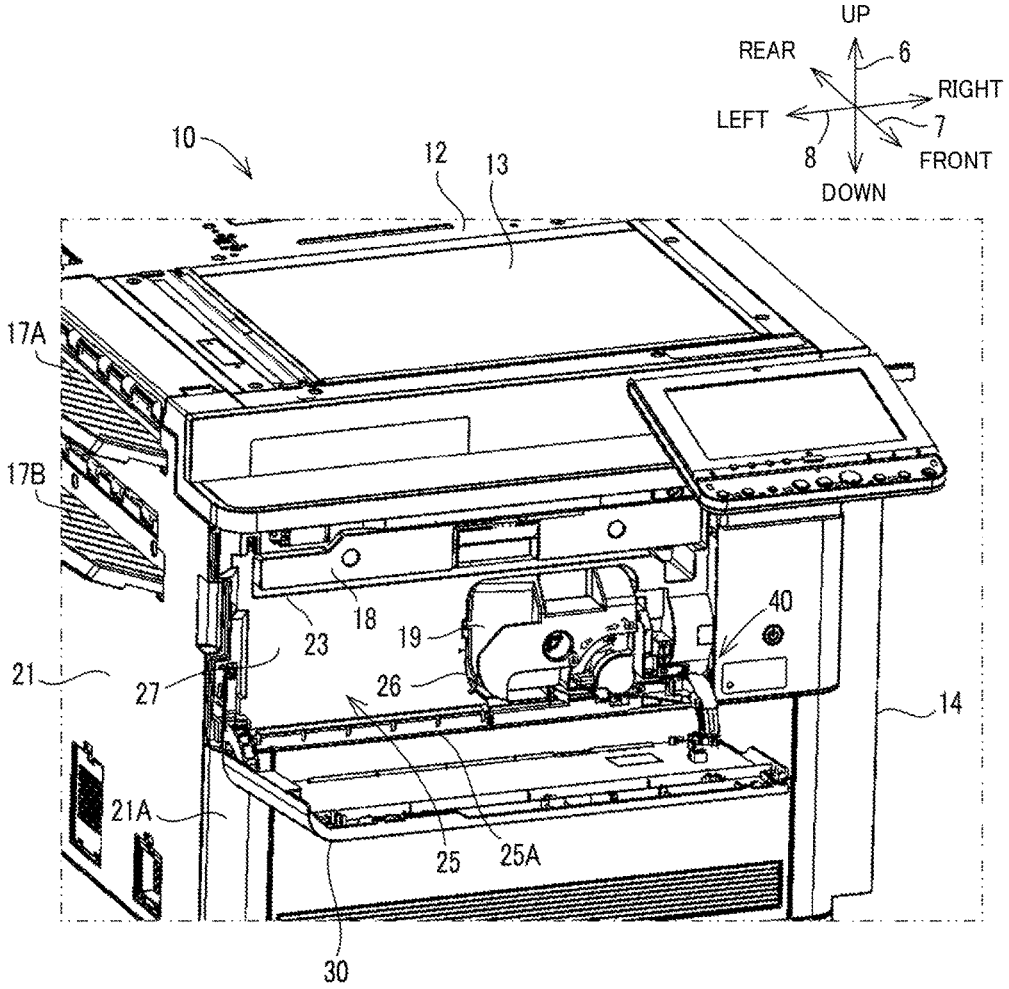
FIG. 2 is a partial enlargement diagram showing a front opening and a cover of the image forming apparatus shown in FIG. 1.

The image forming apparatus 10 includes an image reading portion 12, an image forming portion 14, a sheet feed device 16, and a sheet relay device 18 (see FIG. 2). The image reading portion 12 executes a process (image reading process) of reading an image from a document sheet, and is provided in an upper part of the image forming apparatus 10. The image forming portion 14 executes a process (image forming process) of forming an image based on an electrophotographic system, and is provided below the image reading portion 12. The sheet feed device 16 picks up print sheets stored therein one by one, and feeds the print sheets to the image forming portion 14. The sheet feed device 16 is provided in a lower part of the image forming apparatus 10.

The image reading portion 12 executes the image reading process of reading image data from a document sheet conveyed by an ADF (not shown), or from a document sheet placed on a contact glass 13. It is noted that a document sheet pressing is omitted in FIG. 1. The image reading portion 12 is well-known, and detailed description thereof is omitted.

The image forming portion 14 executes the image forming process (print process) based on image data read by the image reading portion 12, or based on a print job input from an external information processing apparatus such as a personal computer.

The image forming apparatus 10 includes a housing 21 as an apparatus main body. The housing 21 includes an exterior frame and an internal frame, wherein the exterior frame includes exterior panels of the image forming portion 14 and the sheet feed device 16, and the internal frame supports components of the image forming apparatus 10. The exterior frame covers the whole image forming apparatus 10. The housing 21 has an approximately rectangular parallelepiped shape as a whole. In the housing 21, a sheet relay device 18 (see FIG. 2), a toner container 19 (see FIG. 2), and a sheet feed device 16 are provided as well as the components constituting the image forming portion 14.

The image forming portion 14 includes an image transfer portion and a fixing device. The image transfer portion and the fixing device are provided in an inside of the housing 21. The image transfer portion includes a photoconductor drum, a charging device, an exposure device, a developing device, a transfer device, and an electricity removing device. In the image forming portion 14, the image forming process based on image data is performed on a print sheet fed by the sheet feed device 16. For example, when a print job including a print instruction is input from an external apparatus, the charging device uniformly charges the photoconductor drum to a predetermined potential. Next, the exposure device irradiates light to the surface of the photoconductor drum based on image data contained in the print job. This allows an electrostatic latent image to be formed on the surface of the photoconductor drum. The electrostatic latent image on the photoconductor drum is developed (visualized) by the developing device as a toner image. Subsequently, the toner image formed on the photoconductor drum is transferred to a print sheet by the transfer device. After the transfer, the potential of the photoconductor drum is removed by the electricity removing device. Subsequently, the toner image transferred to the print sheet is heated by the fixing device when the print sheet passes through the fixing device, and is fixed to the print sheet.

As shown in FIG. 2, an upper sheet discharge tray 17A and a lower sheet discharge tray 17B are provided on a left side surface of the housing 21 in alignment in the up-down direction. The print sheet that has passed through the fixing device is conveyed from the right side of the housing 21 to the left side through a sheet relay device 18 that is disposed in an upper part of the housing 21, and is discharged to either the upper sheet discharge tray 17A or the lower sheet discharge tray 17B.

In the present embodiment, a rectangular opening 25 is formed in a front surface 21A of the housing 21. In addition, a cover 30 configured to close the opening 25 is provided on the front surface 21A of the housing 21. The opening 25 is opened in a case where a maintenance of the inside of the housing 21 is performed. More specifically, when a detachment or an attachment of the sheet relay device 18, a toner container 19 or the like is performed, the opening 25 is opened by moving the cover 30 from a closing position to an opening position.

A relay device attachment portion 23 to which the sheet relay device 18 is attached is provided on an inner side of the opening 25. The relay device attachment portion 23 is provided in an upper part of an inner space that is on the inner side of the opening 25. Specifically, as shown in FIG. 2, an inner cover 27 is provided in an inner side of the opening 25, and the relay device attachment portion 23 is provided in an upper part of the inner cover 27. The inner cover 27 is fixed to the housing 21 by screws or the like. The relay device attachment portion 23 supports the sheet relay device 18 such that the sheet relay device 18 can slide in the front-rear direction 7. Accordingly, when a worker performs a maintenance or removes a print sheet jammed in the sheet relay device 18, the worker opens the cover 30. This makes it possible to draw out the sheet relay device 18 from an attachment position shown in FIG. 2 to outside of the opening 25.

The toner container 19 stores toner that is replenished to the developing device. As shown in FIG. 2, the toner container 19 is attached to the housing 21. When the toner is replenished from the toner container 19 to the developing device, and the toner container 19 becomes empty, the toner container 19 is replaced with a new toner container 19 filled with toner.

A container attachment portion 26 to which the toner container 19 is attached is provided on an inner side of the opening 25. The container attachment portion 26 is provided in a lower right part of an inner space that is provided on an inner side of the opening 25. Specifically, as shown in FIG. 2, the container attachment portion 26 is provided in a lower right part of the inner cover 27. The container attachment portion 26 supports the toner container 19 such that the toner container 19 can slide in the front-rear direction 7. Accordingly, when the worker performs a maintenance or replaces the toner container 19, the worker opens the cover 30 and detaches the toner container 19 by pulling it toward himself/herself from the attachment position shown in FIG. 2 to outside of the opening 25. In addition, in a state where the cover 30 is opened, the worker can insert a new toner container 19 from the opening 25 and attach it to the container attachment portion 26.

As described above, the housing 21 includes the cover 30 for opening and closing the opening 25. The cover 30 is supported so as to pivot between a closing position (the position shown in FIG. 1) where it closes the opening 25, and an opening position (the position shown in FIG. 2) where it opens the opening 25, around a vicinity of a lower edge 25A of the opening 25 as a pivoting fulcrum. In the present embodiment, the cover 30 is pivotally supported by hinge portions 40 that are respectively provided at opposite ends of the opening 25 in the width direction.

Meanwhile, a conventional cover is pivotally supported by a support shaft provided at its pivoting center. In the image forming apparatus 10 of the present embodiment, in a case where the support shaft is provided at the lower edge 25A of the opening 25, the opening 25 is not opened completely even in a state where the cover 30 is opened, and the lower edge 25A of the opening 25 is covered with the cover 30. In that case, it is difficult for the worker to access the inside of the housing 21 from the opening 25 for a maintenance. In addition, in a case where the support shaft is provided below the lower edge 25A of the opening 25, the opening 25 is opened completely in a state where the cover 30 is opened. However, this configuration requires a space below the lower edge 25A of the opening 25 to have the support shaft therein. This increases the size of the image forming apparatus 10 and prevents miniaturization thereof. In view of these, in the image forming apparatus 10 of the present embodiment, a support structure that is different from the conventional one is applied to the hinge portions 40. With the configuration, even in a case where the hinge portions 40 are provided on inner side of the opening 25 of the housing 21, it is possible to save space of the housing 21 and open the opening 25 completely in a state where the cover 30 is opened.

[Hinge Portions 40]

In the following, a configuration of the hinge portions 40 is described with reference to FIG. 3 to FIG. 16.

Figure 3:
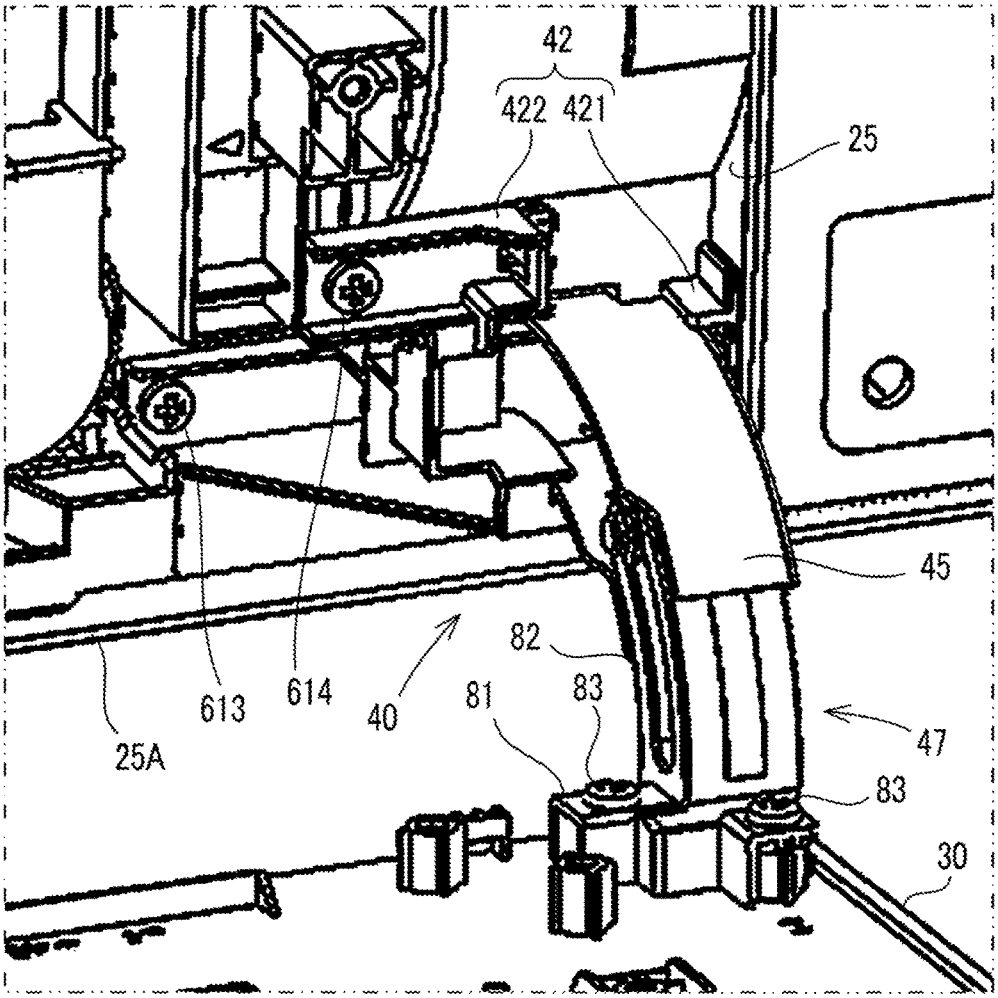
FIG. 3 is a partial enlargement diagram showing a configuration of a hinge portion of the cover.
Figure 4:
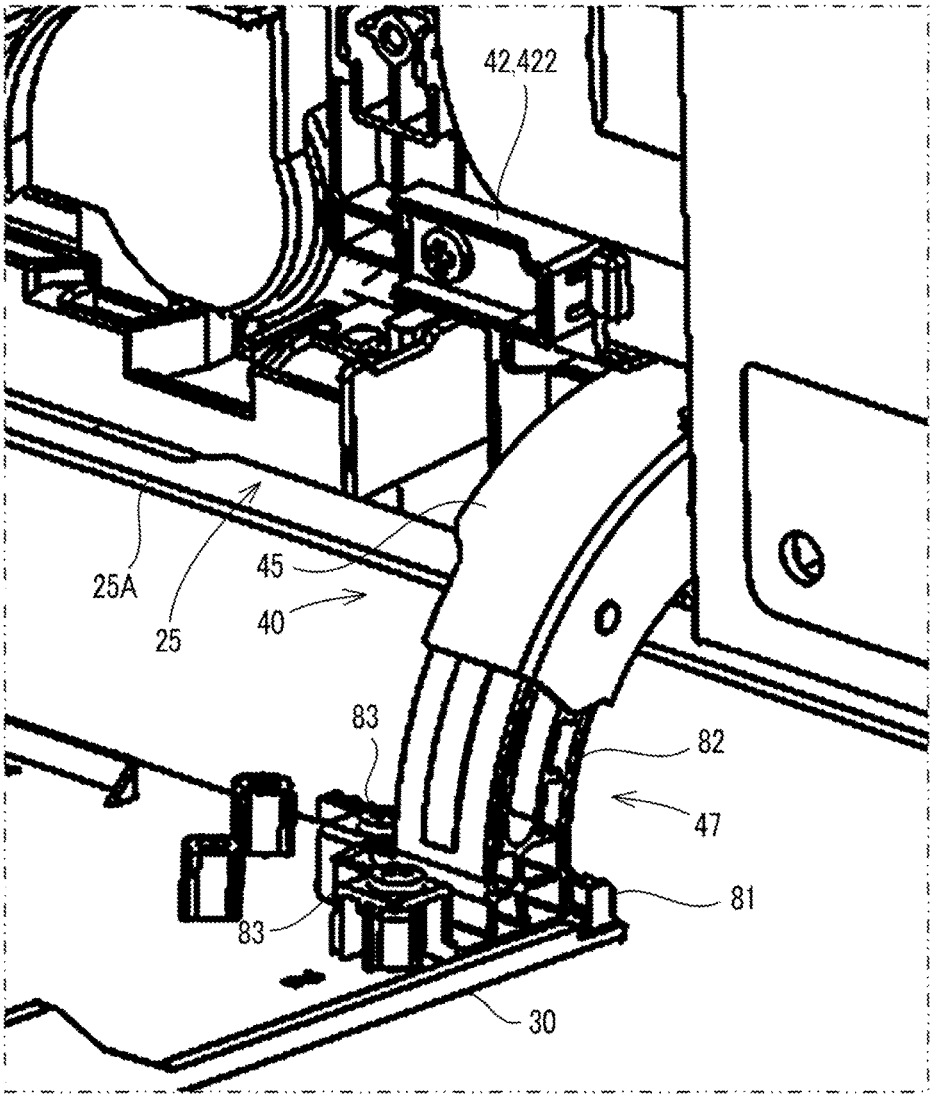
FIG. 4 is a partial enlargement diagram showing a configuration of the hinge portion of the cover.
Figure 5:
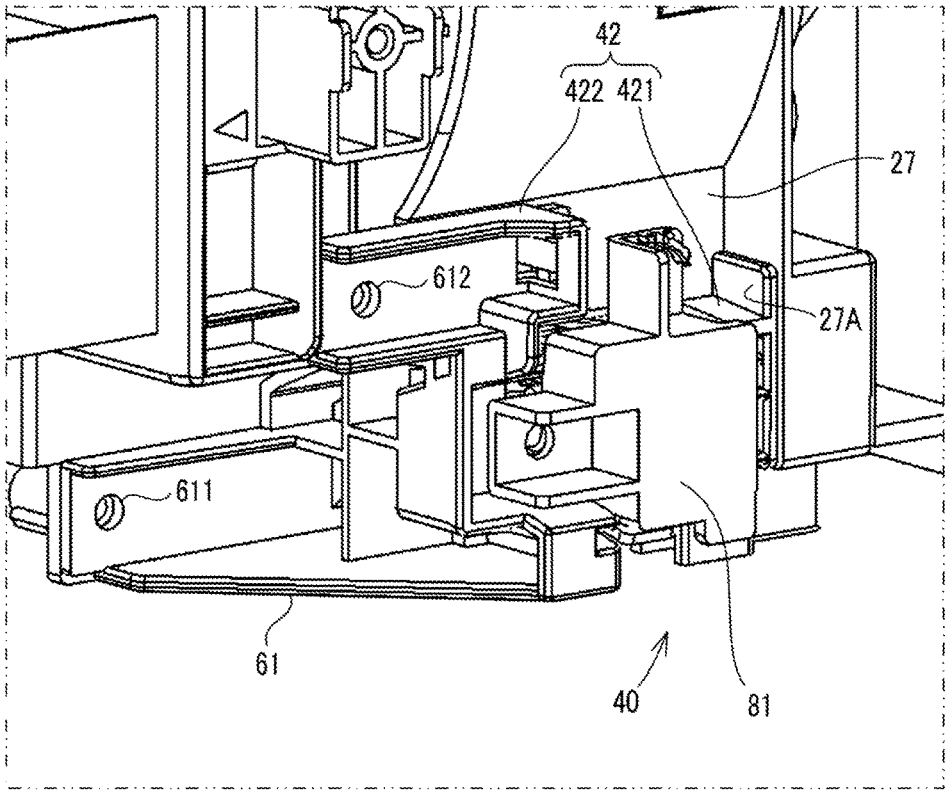
FIG. 5 is a partial enlargement diagram showing a configuration of the hinge portion of the cover.

In the present embodiment, the hinge portions 40 are respectively provided at opposite ends of the opening 25 in the width direction. Since the two hinge portions 40 have the same configuration, in the following, a description is given of the configuration of a hinge portion 40 that is provided at a right end portion of the opening 25 in the width direction. FIG. 3 to FIG. 5 are partially enlarged diagrams of the right hinge portion 40. FIG. 3 and FIG. 4 show the hinge portion 40 in a case where the cover 30 is disposed at the opening position. FIG. 5 shows the hinge portion 40 in a case where the cover 30 is disposed at the closing position. It is noted that in FIG. 5, the cover 30 is omitted.

The hinge portion 40 couples the cover 30 with the housing 21 such that the cover 30 can be opened and closed with respect to the housing 21. In the present embodiment, the cover 30, due to the hinge portions 40, can pivot between the closing position (see FIG. 1) where it closes the opening 25, and the opening position (see FIG. 3 and FIG. 4) where it opens the opening 25. Here, when the cover 30 is at the opening position, an angle of approximately 90 degrees is formed between the cover 30 and the front surface 21A of the housing 21.

As shown in FIG. 3, the hinge portion 40 includes an inner rail member 42, an intermediate rail member 45, and a movable rail member 47, wherein the inner rail member 42 is provided on the inner cover 27, the intermediate rail member 45 is attached to the inner rail member 42, and the movable rail member 47 is attached to the intermediate rail member 45.

[Inner Rail Member 42]

The inner rail member 42 is a resin molded product formed in the shape of an arc, and provided on the inner side of the opening 25 in the housing 21. The inner rail member 42 includes a first fixed rail member 421 and a second fixed rail member 422, wherein the first fixed rail member 421 is integrally formed with the inner cover 27, and the second fixed rail member 422 is fixed to the inner cover 27 by two screws 613 and 614. The inner rail member 42 slidably supports the intermediate rail member 45 by the first fixed rail member 421 and the second fixed rail member 422.

The first fixed rail member 421 is provided at the lower right corner of the inner cover 27. The inner cover 27 is a rectangular resin plate member that corresponds to the opening 25 in shape and extends in the width direction. A right side wall 27A (see FIG. 5) is formed at the lower right corner of the inner cover 27 to extend from the front surface of the inner cover 27 rearward. The first fixed rail member 421 is integrally formed with a surface of the right side wall 27A.

Figure 6:
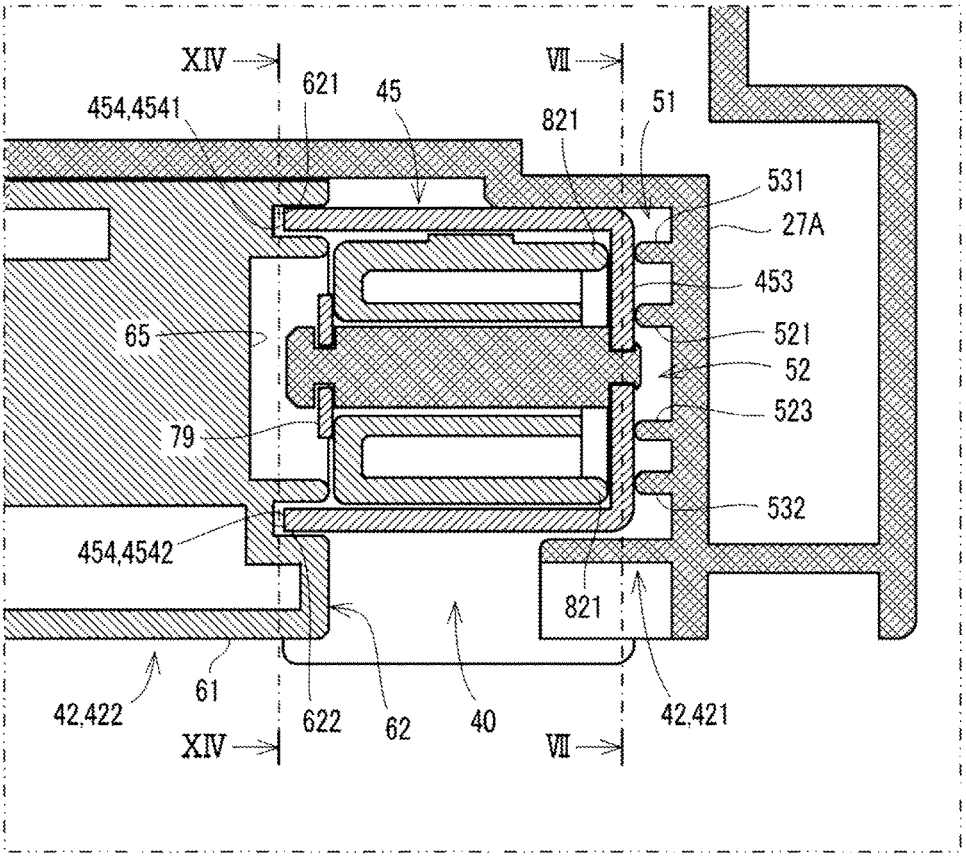
FIG. 6 is a cross-sectional diagram showing a cross-section of the hinge portion in a state where the cover is closed.
Figure 7:
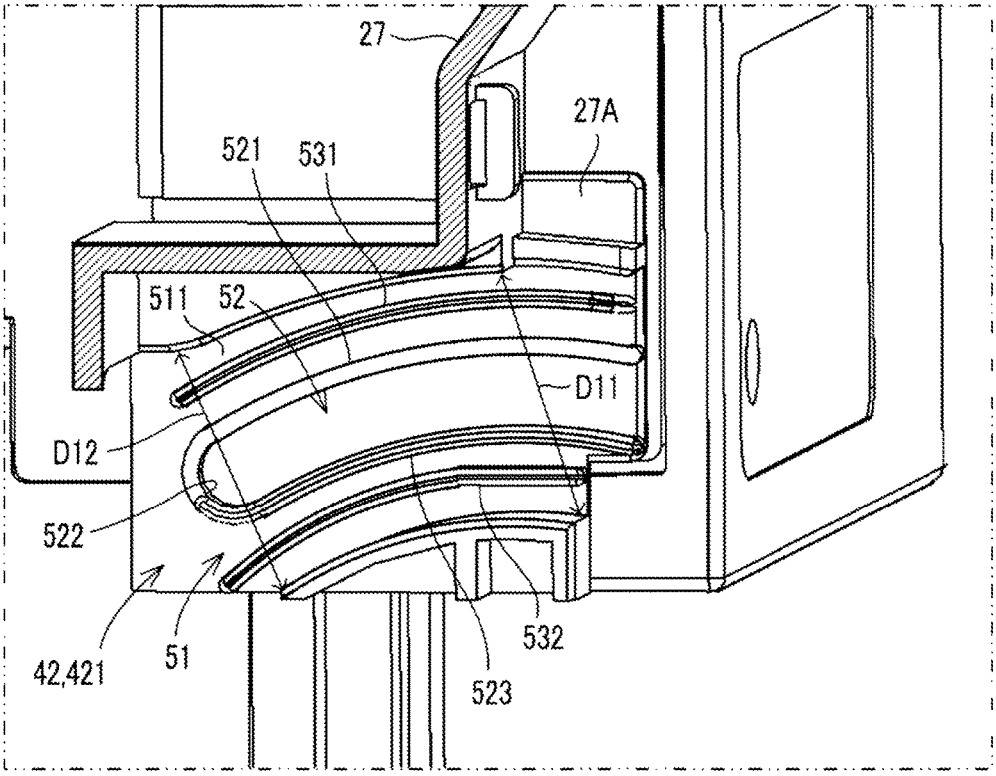
FIG. 7 is a cross-sectional diagram taken along a VII-VII line and viewed from the direction of arrows of FIG. 6, and shows a first fixed rail member which constitutes a right part of an inner rail member included in the hinge portion.

FIG. 6 is longitudinal sectional diagram of the hinge portion 40 in a case where the cover 30 is disposed at the closing position. FIG. 6 shows a cross-section of the hinge portion 40 taken along a cutting surface that passes through a guide pin 71 (see FIG. 10) described below. FIG. 7 is a cross-sectional diagram taken along the VII-VII line and viewed from the direction of arrows of FIG. 6, and shows the first fixed rail member 421 which constitutes a right part of the inner rail member 42 included in the hinge portion 40. It is noted that the intermediate rail member 45 and the movable rail member 47 are omitted in FIG. 7.

As shown in FIG. 7, the first fixed rail member 421 includes an arc-shaped center rail guide 51 (an example of the first rail guide of the present disclosure) that guides a right side portion 453 (see FIG. 10, an example of the first side portion of the present disclosure) that is a right side (one side) of the intermediate rail member 45. The center rail guide 51 is formed in the shape of an arc groove extending from the front side to the rear side. In FIG. 7, a sign D11 represents an opening port of the center rail guide 51 on the front side, and a sign D12 represents an opening port of the center rail guide 51 on the rear side. The center rail guide 51 is formed in the shape of a groove whose width is the same from the opening port D11 to the opening port D12. In addition, the center rail guide 51 is formed in the shape of an arc whose center point (not shown) is located below the lower edge 25A (see FIG. 2) of the opening 25. In the present embodiment, the opening port D11 is above the opening port D12, and the center rail guide 51 is gently inclined downward along the arc from the opening port D11 to the opening port D12, wherein the top of the arc is the opening port D11.

A regulation guide rail 52 is formed on a bottom surface 511 of the center rail guide 51, wherein the regulation guide rail 52 is formed in the shape of an arc extending in the front-rear direction 7. The regulation guide rail 52 is formed on the bottom surface 511 at the center of the center rail guide 51 in the up-down direction 6 (the vertical width direction). The regulation guide rail 52 is composed of a rib 521, a terminal portion 522, and a rib 523 that are formed continuously, wherein the rib 521 is in the shape of an arc that extends from the front side to the rear side, the terminal portion 522 is curved in the shape of an arc from the rear end portion of the rib 521, and the rib 523 is in the shape of an arc that extends from the terminal portion 522 to the front side. The width (interval between the rib 521 and the rib 523) of the regulation guide rail 52 is constant.

The regulation guide rail 52 is formed in the shape of an arc whose center point is the same as that of the center rail guide 51. The front side of the regulation guide rail 52 extends up to approximately the same position as the opening port D11, and its front end portion is opened frontward as is the case with the opening port D11. The rear side of the regulation guide rail 52 extends up to to approximately the same position as the opening port D12, and its rear end portion is closed by the arc-shaped terminal portion 522.

The terminal portion 522 stops movement of the intermediate rail member 45 at a first position (the position shown in FIG. 14) that is described below, and is an example of the first stop portion of the present disclosure. As described below, in a state where the intermediate rail member 45 is attached to the inner rail member 42, a projection portion 73 (see FIG. 11) of the right side portion 453 of the intermediate rail member 45 is inserted in the regulation guide rail 52. This allows the projection portion 73 to relatively move along the regulation guide rail 52. Since the terminal portion 522 is formed in the regulation guide rail 52, the intermediate rail member 45 is prevented from sliding further from the first position. Specifically, the projection portion 73 abuts on the terminal portion 522 at the first position. This prevents the intermediate rail member 45 from sliding from the first position rearward. That is, the terminal portion 522 has a role of a stopper that regulates the intermediate rail member 45 from sliding from the first position rearward.

In addition, two arc-shaped ribs 531 and 532 are formed on the bottom surface 511. On the bottom surface 511, the rib 531 is formed in a region above the regulation guide rail 52, and the rib 532 is formed in a region below the regulation guide rail 52. As shown in FIG. 6, the ribs 531 and 532 have the same size and height as the regulation guide rail 52, and in a state where the intermediate rail member 45 is attached to the inner rail member 42, tips of the regulation guide rail 52 and the ribs 531 and 532 come into contact with the right side portion 453 of the inner rail member 42.

As shown in FIG. 6, the second fixed rail member 422 is disposed to face the first fixed rail member 421, and is disposed on the left side of the first fixed rail member 421 with a predetermined interval therebetween. The second fixed rail member 422 is a resin molded product, and includes a base portion 61 that includes two screw holes 611 and 612. In the present embodiment, the second fixed rail member 422 is fixed to the inner cover 27 by the screws 613 and 614 (see FIG. 3) inserted in the screw holes 611 and 612.

Figure 8:
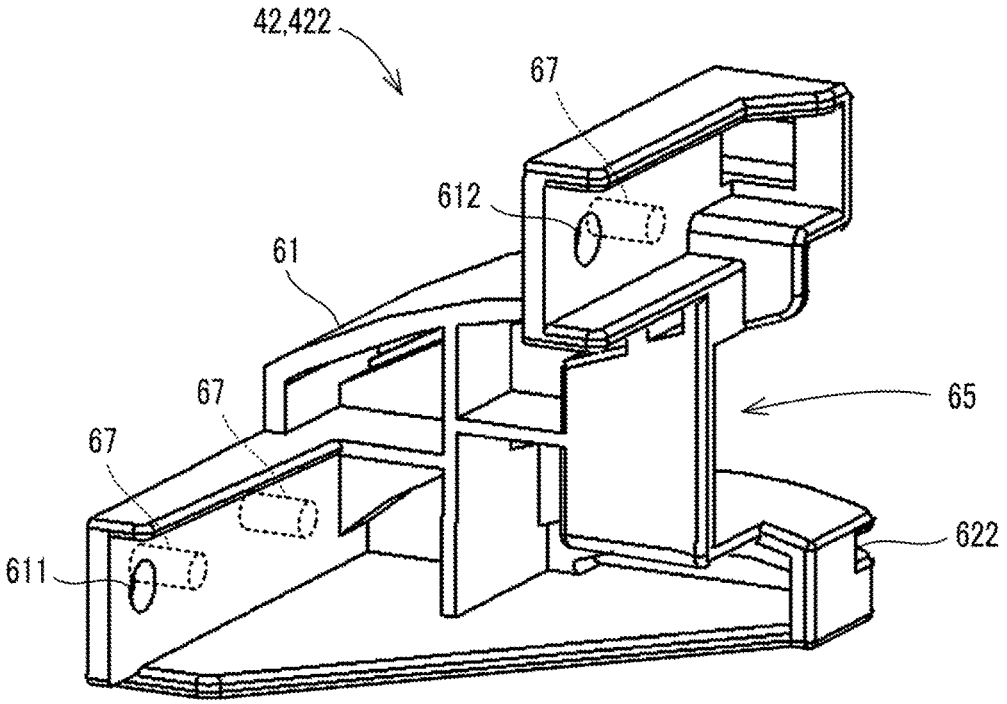
FIG. 8 is a perspective diagram showing a configuration of a second fixed rail member which constitutes a left part of the inner rail member included in the hinge portion.
Figure 9:
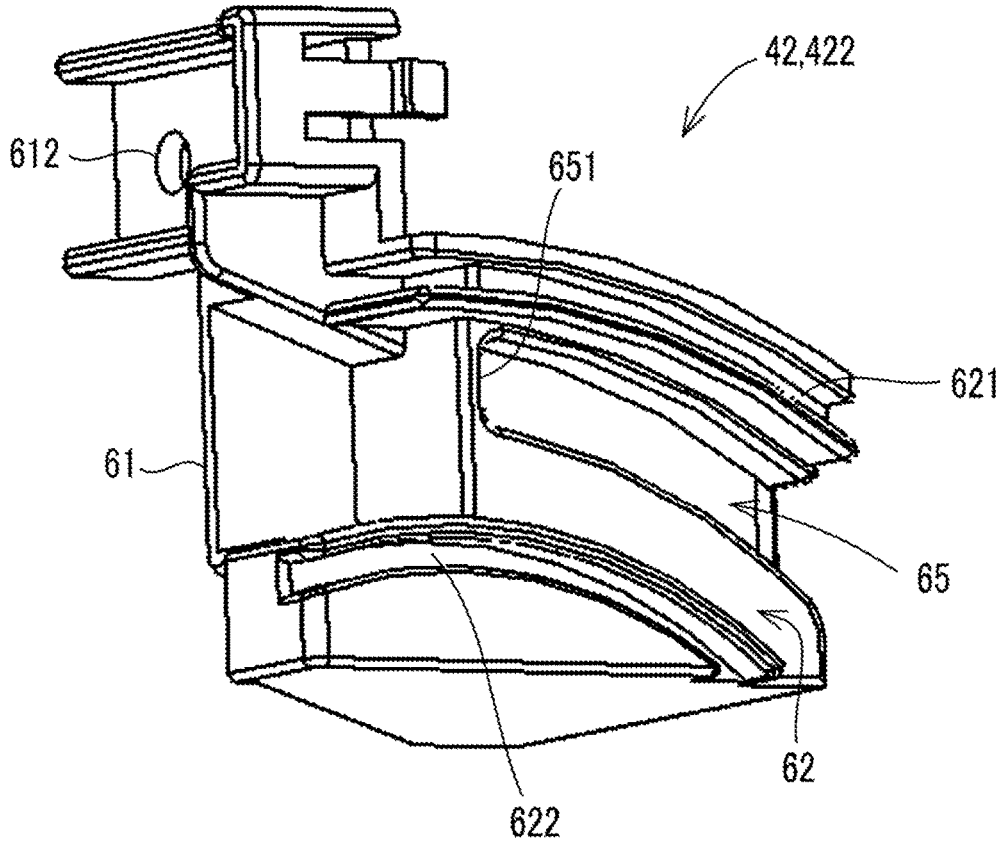
FIG. 9 is a perspective diagram showing a configuration of the second fixed rail member which constitutes the left part of the inner rail member included in the hinge portion.

FIG. 8 and FIG. 9 are perspective diagrams showing a single body of the second fixed rail member 422. The second fixed rail member 422 includes a support surface 62 that faces the center rail guide 51 of the first fixed rail member 421.

As shown in FIG. 9, the second fixed rail member 422 includes an upper rail guide 621 and a lower rail guide 622 (both are an example of the second rail guide of the present disclosure) of an arc groove shape that guide a left side portion 454 (see FIG. 6, an example of the second side portion of the present disclosure) that is a left side (the other side) of the intermediate rail member 45. The upper rail guide 621 and the lower rail guide 622 are formed on the support surface 62, and are arranged in alignment with a predetermined interval in the up-down direction 6. With regard to each of the upper rail guide 621 and the lower rail guide 622, an end portion thereof on the front side is opened frontward, and an end portion thereof on the rear side is opened rearward. As shown in FIG. 6, an upper projection end 4541 of the left side portion 454 of the intermediate rail member 45 is inserted in the upper rail guide 621, and a lower projection end 4542 of the left side portion 454 is inserted in the lower rail guide 622.

The upper rail guide 621 is formed on the support surface 62 at a higher position than the center of the support surface 62 in the up-down direction 6. Specifically, the upper rail guide 621 is formed on an upper end portion of the support surface 62. In addition, the lower rail guide 622 is formed on the support surface 62 at a lower position than the center of the support surface 62 in the up-down direction 6. Specifically, the lower rail guide 622 is formed on a lower end portion of the support surface 62. Each of the upper rail guide 621 and the lower rail guide 622 is formed in the shape of an arc whose center point (not shown) is located below the lower edge 25A (see FIG. 2) of the opening 25. In the present embodiment, the center point of the arc of the center rail guide 51 and the center points of the arcs of the upper rail guide 621 and the lower rail guide 622 are located at the same position in the up-down direction 6 and the front-rear direction 7.

A regulation guide rail 65 of an arc groove shape is formed on the support surface 62. The regulation guide rail 65 is formed approximately at the center of the support surface 62 in the up-down direction 6. The regulation guide rail 65 is a groove of an arc shape and extends from the front side to the rear side, and the width thereof in the up-down direction 6 is constant.

The regulation guide rail 65 is formed in the shape of an arc that has the same center point as the upper rail guide 621 and the lower rail guide 622. As shown in FIG. 9, the front side of the regulation guide rail 65 is closed by a terminal portion 651. The rear side of the regulation guide rail 65 is opened rearward.

The terminal portion 651 stops movement of the intermediate rail member 45 at a second position (the position shown in FIG. 15 and FIG. 16) that is described below, and is an example of the second stop portion of the present disclosure. As described below, in a state where the intermediate rail member 45 is attached to the inner rail member 42, a tip portion 711 (see FIG. 10) of the guide pin 71 of the intermediate rail member 45 is inserted in the regulation guide rail 65. This allows the tip portion 711 to relatively move along the regulation guide rail 65. Since the terminal portion 651 is formed in the regulation guide rail 65, the intermediate rail member 45 is prevented from sliding further from the second position. Specifically, the tip portion 711 abuts on the terminal portion 651 at the second position. This prevents the intermediate rail member 45 from sliding from the second position frontward. That is, the terminal portion 651 has a role of a stopper that regulates the intermediate rail member 45 from sliding from the second position frontward.

In addition, as shown in FIG. 8, three positioning projection portions 67 are provided on a mounting surface of the second fixed rail member 422 that is mounted to the inner cover 27. The positioning projection portions 67 are erected vertical to the mounting surface. Two positioning projection portions 67 are formed in the vicinity of the screw hole 611, and one positioning projection portion 67 is formed in the vicinity of the screw hole 612. In the inner cover 27, engaging holes (not shown) are formed at positions corresponding to the positioning projection portions 67. As described above, since the second fixed rail member 422 is fixed to the inner cover 27 by the two screws 613 and 614, the mounting position of the second fixed rail member 422 on the inner cover 27 is not determined constantly, and there would be a case where the intermediate rail member 45 is not supported by the inner rail member 42 so as to slide smoothly. As a result, in the present embodiment, a plurality of positioning projection portions 67 are provided in the vicinity of the screw holes 611 and 612, and the positioning projection portions 67 are inserted in and engaged with the engaging holes. This allows the second fixed rail member 422 to be mounted on the inner cover 27 at a predetermined position correctly. Thereafter, the second fixed rail member 422 is fixed to the inner cover 27 by the screws 613 and 614.

With this configuration, even when the rotational force of the screws 613 and 614 is added during screwing thereof, the second fixed rail member 422 is prevented from being positionally shifted with respect to the inner cover 27.

[Intermediate Rail Member 45]

The intermediate rail member 45 is a resin molded product, and is slidably supported by the inner rail member 42. In the present embodiment, the intermediate rail member 45 is formed in the shape of an arc that has the same center point as the arcs of the center rail guide 51 of the inner rail member 42, the upper rail guide 621, and the lower rail guide 622. Supported by the inner rail member 42, the intermediate rail member 45 is displaced between the first position and the second position so as to draw an arc along the arcs of the center rail guide 51 of the inner rail member 42, the upper rail guide 621, and the lower rail guide 622, wherein the first position (the position shown in FIG. 14) is disposed on the inner side of the opening 25 (see FIG. 2), and the second position (the position shown in FIG. 15 and FIG. 16) is on the outer side of the opening 25. In the following, the configuration of the intermediate rail member 45 is described.

Figure 10:
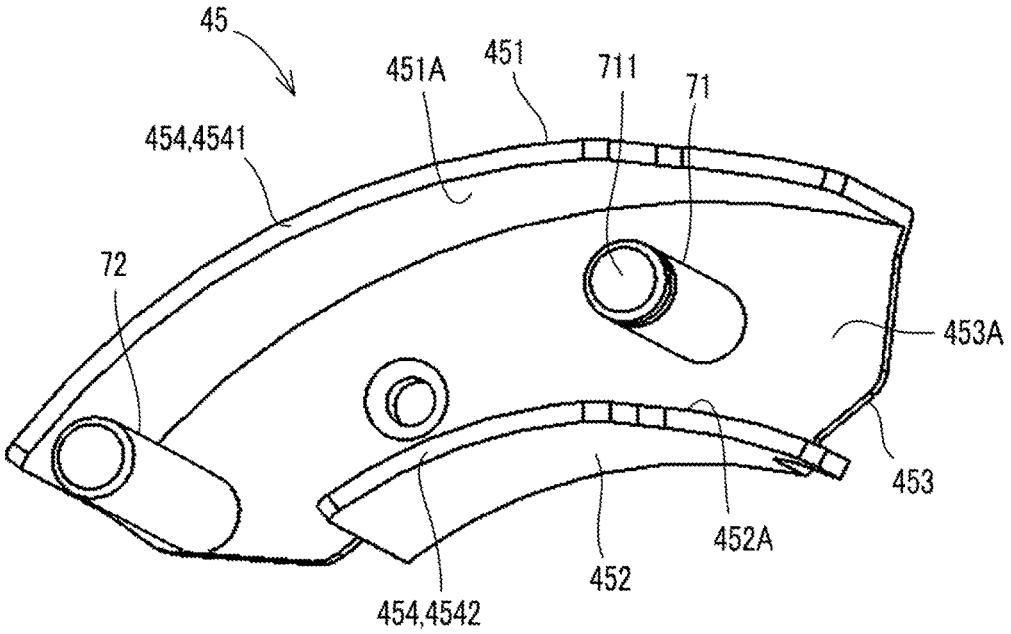
FIG. 10 is a perspective diagram showing a configuration of an intermediate rail member which is included in the hinge portion.
Figure 11:
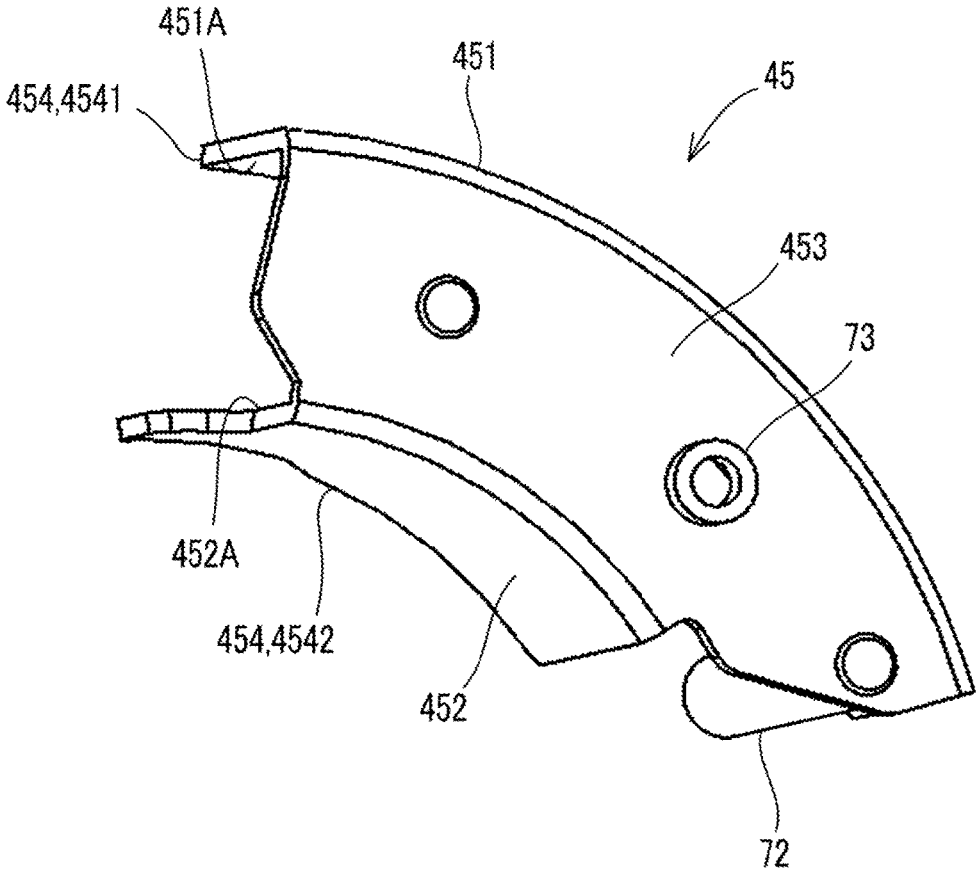
FIG. 11 is a perspective diagram showing a configuration of the intermediate rail member which is included in the hinge portion.
Figure 14:
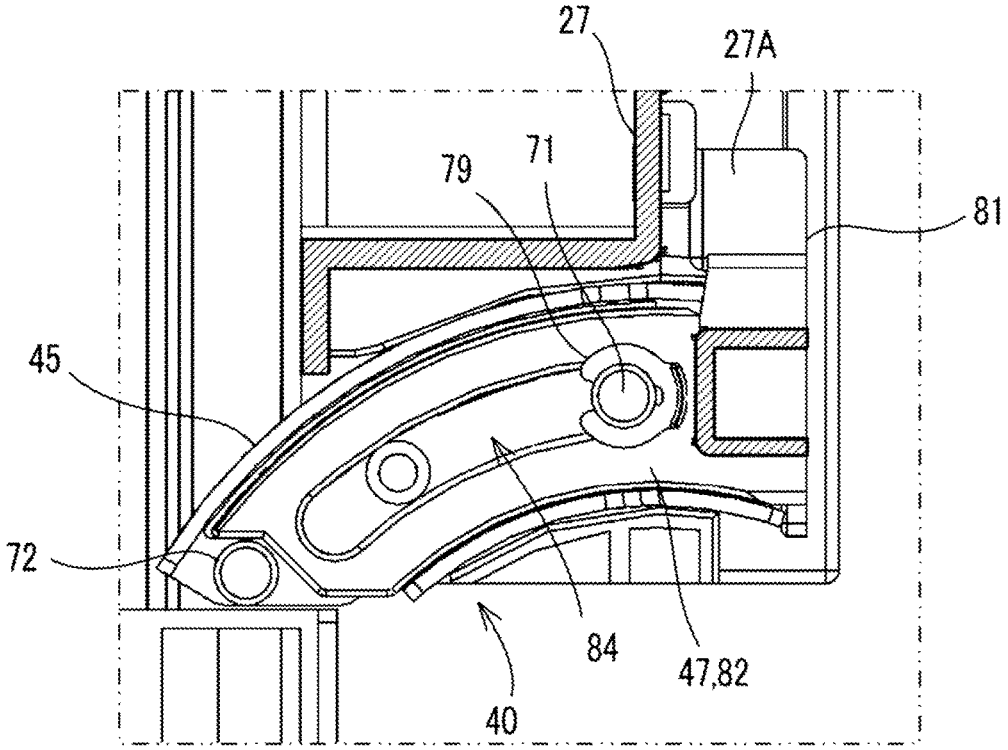
FIG. 14 is a cross-sectional diagram taken along an XIV-XIV line and viewed from the direction of arrows of FIG. 6, and shows the hinge portion in a state where the cover is closed.

FIG. 10 and FIG. 11 are perspective diagrams showing a single body of the intermediate rail member 45. The intermediate rail member 45 includes the right side portion 453 that is a plate-like member of an arc shape and configured to abut on the center rail guide 51 of the first fixed rail member 421. An upper guide portion 451 projects vertically from an arc edge of an upper end of the right side portion 453, and a lower guide portion 452 projects vertically from an arc edge of a lower end of the right side portion 453. As shown in FIG. 14, the intermediate rail member 45 is formed in such a size that the right side portion 453 can be inserted in the center rail guide 51 of the first fixed rail member 421. FIG. 14 shows the hinge portion 40 in a state where the cover 30 is closed. In a state where the right side portion 453 of the intermediate rail member 45 is inserted in the center rail guide 51, the movable rail member 47 is attached to the inside of the intermediate rail member 45, and in this state, the second fixed rail member 422 is mounted on the inner cover 27. When the second fixed rail member 422 is mounted on the inner cover 27, the upper projection end 4541 (an example of the second side portion of the present disclosure) of the upper guide portion 451 of the intermediate rail member 45 is inserted in the upper rail guide 621, and the lower projection end 4542 (an example of the second side portion of the present disclosure) of the lower guide portion 452 of the intermediate rail member 45 is inserted in the lower rail guide 622. This allows the intermediate rail member 45 to be supported by the inner rail member 42 so as to slide between the first position and the second position.

As shown in FIG. 10, the intermediate rail member 45 includes a guide pin 71 and a stopper pin 72. Each of the guide pin 71 and the stopper pin 72 is a cylindrical pin member erected vertical to an inner side surface 453A (an example of the third guide surface of the present disclosure) of the right side portion 453, and is made of, for example, a metal that has higher rigidity and hardness than resin. The guide pin 71 and the stopper pin 72 are fixed to the inner side surface 453A of the right side portion 453 by calking work.

In the present embodiment, the movable rail member 47 is slidably supported in an inside of the intermediate rail member 45, namely, in an inner space surrounded by the upper guide portion 451, the lower guide portion 452, and the right side portion 453. That is, the intermediate rail member 45 supports the movable rail member 47 such that the movable rail member 47 can slide between a third position and a fourth position that are described below. In addition, in the configuration where the movable rail member 47 is supported in the inside of the intermediate rail member 45, an arc-shaped inner surface 451A (an example of the first guide surface of the present disclosure) of the upper guide portion 451 guides an upper surface 82A of a supported portion 82 of the movable rail member 47 in a sliding direction along the arc shape, wherein the supported portion 82 is described below. In addition, in the state where the movable rail member 47 is supported in the inside of the intermediate rail member 45, a guide rib 821 (an example of the third side portion of the present disclosure) at the right side of the supported portion 82 is guided in the sliding direction while contacting the inner side surface 453A.

When the movable rail member 47 is attached to the intermediate rail member 45, the guide pin 71 is inserted in an arc-shaped guide hole 84 (see FIG. 12, an example of the third rail guide of the present disclosure) formed in the movable rail member 47. In the state where the guide pin 71 is inserted in the guide hole 84, a coupling tool 79 (see FIG. 14) such as a C-type ring is attached to an engaging groove provided on the tip portion 711 side of the guide pin 71. This prevents the guide pin 71 from escaping from the guide hole 84.

As shown in FIG. 14, the guide pin 71 is provided on a front-side part of the right side portion 453. When the guide pin 71 is inserted in the guide hole 84, the movable rail member 47 is guided to slide, and the sliding position is regulated. Specifically, when the movable rail member 47 is disposed at a fourth position (the position shown in FIG. 16) that is farthest from the intermediate rail member 45, the guide pin 71 abuts on a rear end portion 841 (see FIG. 12) of the guide hole 84, and is regulated from further sliding.

The stopper pin 72 is disposed at a position so as to abut on a rear end portion 85 (see FIG. 12) of the movable rail member 47 when the movable rail member 47 is attached to the intermediate rail member 45. As shown in FIG. 14, the stopper pin 72 is disposed on a rear side of the guide pin 71. Specifically, the stopper pin 72 is provided on a rear end part of the right side portion 453. With the stopper pin 72 disposed in this way, the sliding position of the movable rail member 47 is regulated. Specifically, when the movable rail member 47 is disposed at the third position (the position shown in FIG. 14 and FIG. 15) inside the intermediate rail member 45, the stopper pin 72 abuts on the rear end portion 85 of the movable rail member 47, and further sliding is regulated.

As shown in FIG. 11, the projection portion 73 that is inserted in the regulation guide rail 52, is formed on the right side portion 453 of the intermediate rail member 45. The projection portion 73 is provided on a right side surface of the right side portion 453, namely, on a surface that faces the regulation guide rail 52. In a state where the intermediate rail member 45 is attached to the inner rail member 42, the projection portion 73 is inserted in the regulation guide rail 52. In the present embodiment, in a state where the intermediate rail member 45 is disposed at the first position, the projection portion 73 abuts on the terminal portion 522 of the regulation guide rail 52. This regulates the intermediate rail member 45 from further sliding from the first position rearward. That is, the terminal portion 522 regulates the intermediate rail member 45 from sliding from the first position rearward.

[Movable Rail Member 47]

The movable rail member 47 is a resin molded product, and slidably supported by the intermediate rail member 45 described above. The movable rail member 47 includes a coupling portion 81 and the supported portion 82, wherein the coupling portion 81 is coupled with the cover 30, and the supported portion 82 is slidably supported by the intermediate rail member 45. In the present embodiment, being supported by the intermediate rail member 45, the supported portion 82 of the movable rail member 47 is displaced so as to draw an arc between the third position and the fourth position which is more on an outer side of the opening 25 (see FIG. 2) than the third position, wherein at the third position (the position shown in FIG. 14 and FIG. 15), the coupling portion 81 is disposed on the intermediate rail member 45 side, and at the fourth position, the coupling portion 81 is disposed below the lower edge 25A (see FIG. 2) of the opening 25. In the following, the movable rail member 47 is described in detail.

Figure 12:
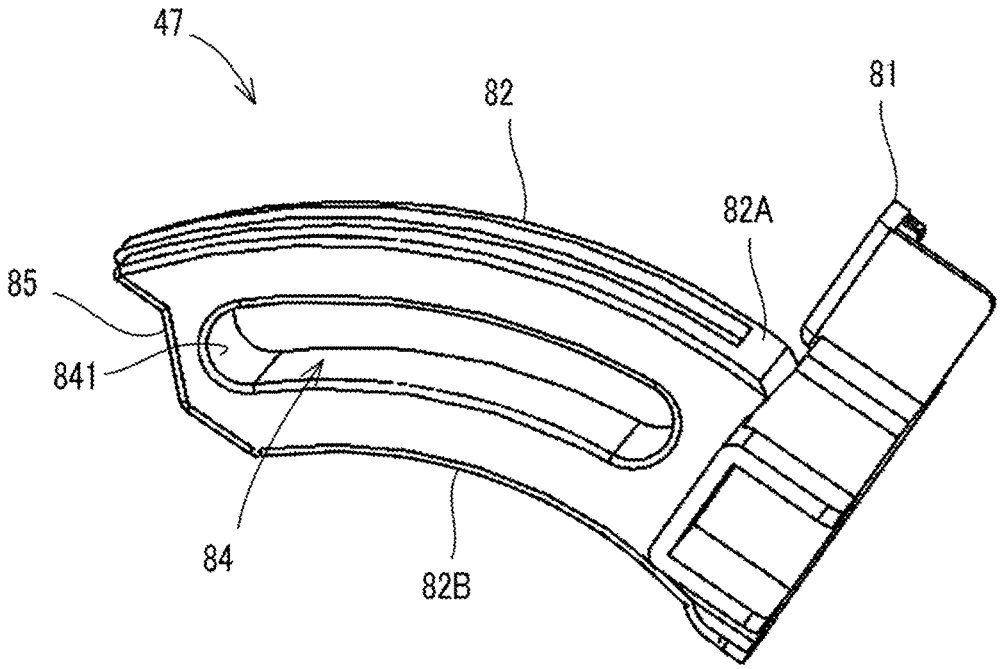
FIG. 12 is a perspective diagram showing a configuration of a movable rail member which is included in the hinge portion.
Figure 13:
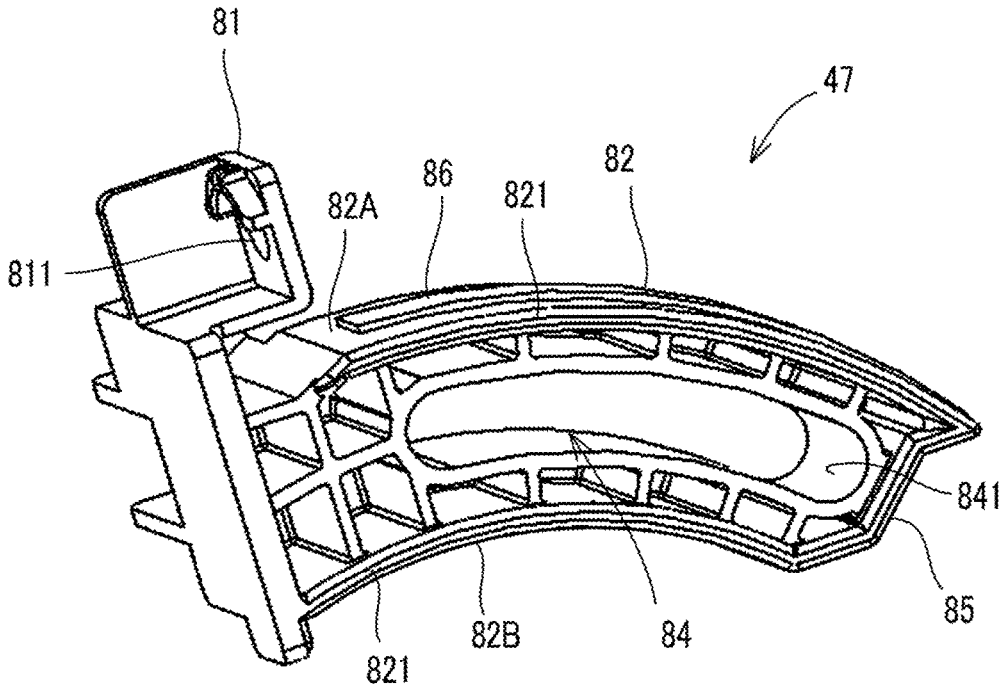
FIG. 13 is a perspective diagram showing a configuration of the movable rail member which is included in the hinge portion.

FIG. 12 and FIG. 13 are perspective diagrams showing a single body of the movable rail member 47. In the coupling portion 81 of the movable rail member 47, a screw hole 811 for fixation to the cover 30 is formed. As shown in FIG. 4, a screw 83 is inserted in the screw hole 811 and screwed into an inner side surface of the cover 30. In the present embodiment, the coupling portions 81 of the two hinge portions 40 are fixed to opposite lower end portions of the cover 30 opposite in the width direction.

As shown in FIG. 12 and FIG. 13, the supported portion 82 is an arc-shaped arm member extending from the coupling portion 81. The supported portion 82 is formed in the shape of an arc whose center point is the same as those of the center rail guide 51 of the inner rail member 42, the upper rail guide 621, and the lower rail guide 622. In addition, as shown in FIG. 14, the supported portion 82 is formed in a size so as to be inserted in the inside of the intermediate rail member 45. With this configuration, the movable rail member 47, in a state of being attached to the intermediate rail member 45, can slide between the third position and the fourth position.

In addition, the guide hole 84 is formed in the supported portion 82, wherein the guide pin 71 is inserted in the guide hole 84 when the movable rail member 47 is attached to the intermediate rail member 45. The guide hole 84 is formed in the shape of an arc whose center point is the same as those of the center rail guide 51, the upper rail guide 621, and the lower rail guide 622. The guide hole 84 with the guide pin 71 inserted therein when the movable rail member 47 is attached to the inner rail member 42, guides the supported portion 82 between the third position and the fourth position. In addition, the guide ribs 821 (an example of the third side portion of the present disclosure) are provided respectively on upper and lower end portions of the supported portion 82 at the right side thereof, wherein the guide ribs 821 abut on the inner side surface 453A of the intermediate rail member 45 when the movable rail member 47 is attached to the intermediate rail member 45. The guide ribs 821 are formed to project rightward.

In a state where the supported portion 82 is attached to the inside of the intermediate rail member 45, the upper surface 82A of the supported portion 82 is guided in a sliding direction along the arc shape by the arc-shaped inner surface 451A (an example of the first guide surface of the present disclosure) of the upper guide portion 451. In addition, a lower surface 82B of the supported portion 82 is guided in the sliding direction while contacting an inner surface 452A (an example of the second guide surface of the present disclosure) of the lower guide portion 452 by a surface contact. Furthermore, in a state where the movable rail member 47 is supported in the inside of the intermediate rail member 45, the guide rib 821 is guided in the sliding direction while contacting the inner side surface 453A (an example of the third guide surface of the present disclosure).

In the present embodiment, a protruding rib 86 (an example of the protruding portion of the present disclosure) is formed on the upper surface 82A of the supported portion 82, wherein the protruding rib 86 protrudes toward the inner surface 451A of the upper guide portion 451. On the upper surface 82A, the protruding rib 86 is formed in an elongated shape to extend in the longitudinal direction of the supported portion 82, and is smaller than the upper surface 82A in width. With the provision of the protruding rib 86, in a state where the supported portion 82 is attached to the intermediate rail member 45, only the protruding rib 86 abuts on the inner surface 451A. With this configuration, compared to a case where the whole upper surface 82A of the supported portion 82 contacts the inner surface 451A, the sliding resistance during sliding movement of the supported portion 82 is small, and the supported portion 82 can slide smoothly. On the other hand, the lower surface 82B of the supported portion 82 is supported while in contact with the inner surface 452A of the lower guide portion 452 of the intermediate rail member 45 by a surface contact, the supported portion 82 is stably supported in the inside of the intermediate rail member 45.

[Operation of Hinge Portion 40]

In the following, an operation of the hinge portion 40 is described with reference to FIG. 14 to FIG. 16.

As shown in FIG. 14, in a state where the cover 30 is disposed at the closing position, the intermediate rail member 45 is disposed at the first position, and the movable rail member 47 is disposed at the third position. In this state, the intermediate rail member 45 and the movable rail member 47 are stored in the inner rail member 42, and the hinge portion 40 is most compact. In addition, at the first position, the projection portion 73 of the intermediate rail member 45 abuts on the terminal portion 522, and thus the intermediate rail member 45 is prevented from further entering the depth side of the inner rail member 42.

Figure 15:
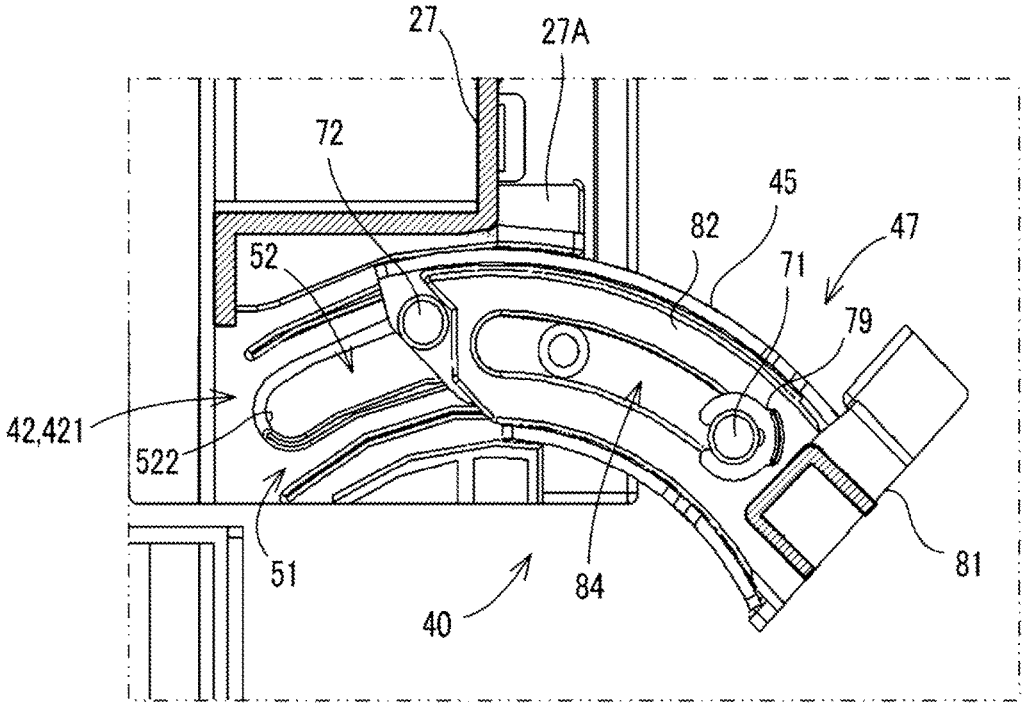
FIG. 15 is a diagram for explaining an operation of the hinge portion, and shows a state where the cover is opened approximately 45 degrees.

Next, when the cover 30 is pivoted approximately 45 degrees from the closing position in the opening direction, in the hinge portion 40, the intermediate rail member 45 is slid from the first position to the second position, as shown in FIG. 15. At this time, the front end of the intermediate rail member 45 is disposed on the front side of the opening 25, and disposed below the lower edge 25A (see FIG. 2) of the opening 25. In addition, at the second position, the tip portion 711 of the guide pin 71 of the intermediate rail member 45 abuts on the terminal portion 651. This prevents the intermediate rail member 45 from sliding from the second position frontward. With this configuration, the intermediate rail member 45 is prevented from escaping from the inner rail member 42.

Figure 16:
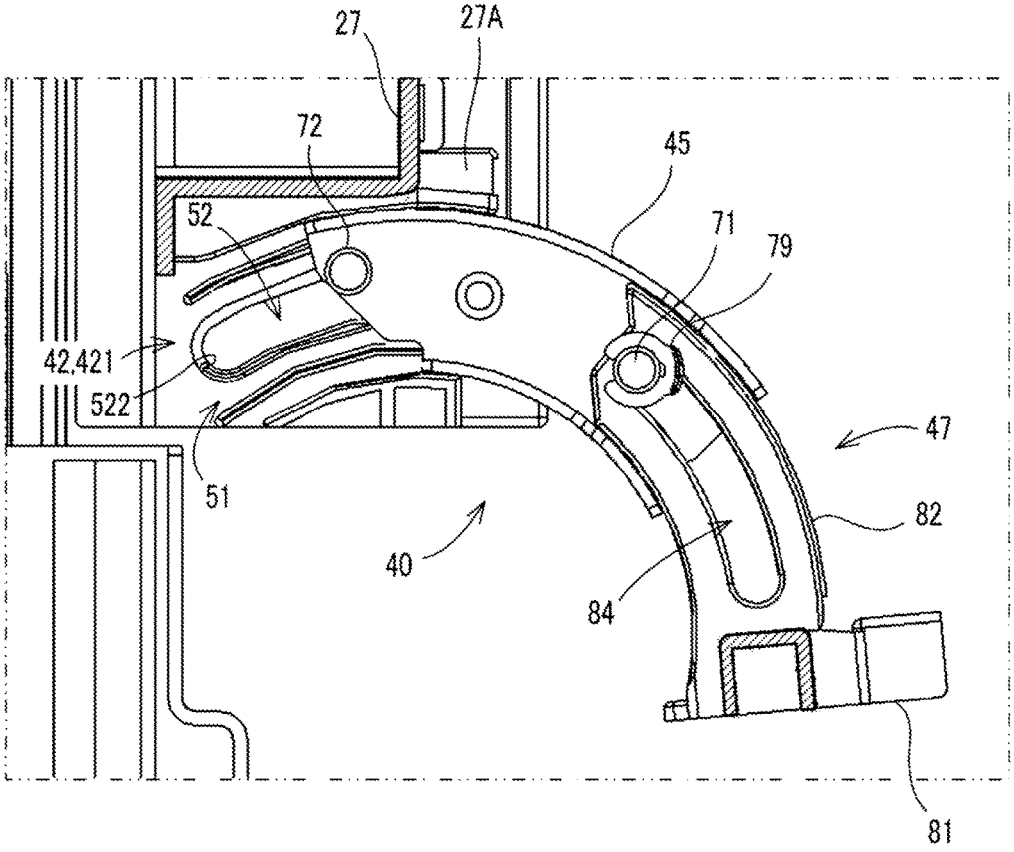
FIG. 16 is a diagram for explaining an operation of the hinge portion, and shows a state where the cover is opened approximately 90 degrees.

When the cover 30 is further pivoted in the opening direction and opened approximately 90 degrees, in the hinge portion 40, the intermediate rail member 45 stays at the second position, and the movable rail member 47 is slid from the third position to the fourth position, as shown in FIG. 16. At this time, the guide pin 71 of the intermediate rail member 45 abuts on a rear end portion 841 (see FIG. 12) of the guide hole 84. This prevents the movable rail member 47 from sliding from the fourth position frontward. As a result, the movable rail member 47 is prevented from escaping from the intermediate rail member 45, and the cover 30 is held at a position where it is opened approximately 90 degrees. Furthermore, in a state where the movable rail member 47 is disposed at the fourth position, the coupling portion 81 is disposed below the lower edge 25A (see FIG. 2) of the opening 25.

With the above-described operation of the hinge portion 40, in a state where the cover 30 is disposed at the opening position, the lower edge 25A of the opening 25 is not covered with the cover 30, and the opening 25 is fully opened. This makes it possible for the worker to detach and attach the sheet relay device 18 or the toner container 19 easily without being obstructed by the cover 30. In addition, although the hinge portion 40 is provided on the inner side of the opening 25, when the cover 30 is disposed at the closing position, as shown in FIG. 14, the inner rail member 42, the intermediate rail member 45, and the movable rail member 47 are overlapped with each other and become compact. Accordingly, compared to a conventional configuration where the cover 30 is supported by a support shaft, it is possible to save space inside the housing 21.

In addition, according to the present embodiment, in a state where the cover 30 is disposed at the opening position, the guide pin 71 is disposed on the front side of the front surface 21A. This allows the worker to easily access the coupling tool 79 of the guide pin 71, and remove the cover 30 easily.

It is noted that in the present embodiment, a configuration where the protruding rib 86 is provided on the upper surface 82A of the supported portion 82 is described as an example. However, not limited to this configuration, the upper surface 82A of the supported portion 82 may be a flat surface, and the protruding rib 86 protruding toward the upper surface 82A may be provided on the inner surface 451A of the upper guide portion 451. Furthermore, in the present embodiment, the protruding rib 86 is described as an example of the protruding portion of the present disclosure. However, the protruding portion of the present disclosure is not limited to the one having the shape of a rib, but may be a plurality of projections provided on the upper surface 82A at predetermined intervals.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a cover configured to close an opening formed in an apparatus main body; and a hinge portion coupling the cover with the apparatus main body in an openable and closable manner, wherein the hinge portion includes:

an arc-shaped inner rail member provided on an inner side of the opening in the apparatus main body;

an arc-shaped intermediate rail member slidably supported by the inner rail member and configured to be displaced between a first position and a second position so as to draw an arc along the inner rail member, the first position being on the inner side of the opening, the second position being on an outer side of the opening; and a movable rail member including a coupling portion and an arc-shaped supported portion, the coupling portion being coupled with the cover, the supported portion being slidably supported by the intermediate rail member, the movable rail member being configured to be displaced between a third position and a fourth position which is more on the outer side of the opening than the third position, wherein at the third position, the coupling portion is disposed on an intermediate rail member side, and at the fourth position, the coupling portion is disposed below a lower edge of the opening.

2. The image forming apparatus according to claim 1, wherein the inner rail member includes:

a first stop portion configured to stop movement of the intermediate rail member at the first position.

3. The image forming apparatus according to claim 2, wherein the inner rail member includes:

an arc-shaped first rail guide configured to guide a first side portion which is one of opposite sides of the intermediate rail member, and the first stop portion is provided in the first rail guide.

4. The image forming apparatus according to claim 1, wherein the inner rail member includes:

a second stop portion configured to stop movement of the intermediate rail member at the second position.

5. The image forming apparatus according to claim 4, wherein the inner rail member includes:

an arc-shaped second rail guide configured to guide a second side portion which is the other of the opposite sides of the intermediate rail member, and the second stop portion is provided in the second rail guide.

6. The image forming apparatus according to claim 1, wherein the intermediate rail member includes:

an arc-shaped first guide surface configured to guide an upper surface of the supported portion of the movable rail member, and a protruding portion protruding toward the first guide surface is provided on the upper surface of the supported portion.

7. The image forming apparatus according to claim 1, wherein the intermediate rail member includes:

an arc-shaped first guide surface configured to guide an upper surface of the supported portion, and a protruding portion protruding toward the upper surface of the supported portion is provided on the first guide surface.

8. The image forming apparatus according to claim 6, wherein the intermediate rail member includes:

a second guide surface configured to guide a lower surface of the supported portion while contacting the lower surface by a surface contact.

9. The image forming apparatus according to claim 1, wherein the intermediate rail member includes:

a third guide surface configured to guide a third side portion which is one of opposite sides of the supported portion; and a guide pin erected vertical to the third guide surface, and the supported portion includes:

an arc-shaped third rail guide configured to guide the supported portion between the third position and the fourth position in a state where the guide pin is inserted therein.

* * * * *